US005582400A

United States Patent [19]

Seydel

[11] Patent Number: 5,582,400

[45] Date of Patent: Dec. 10, 1996

[54] DEVICE FOR CONVEYING SHEETS TO A SHEET PILE

[75] Inventor: Michael Seydel, Eppelheim, Germany

[73] Assignee: Heidelberger Druckmaschinen, Heidelberg, Germany

[21] Appl. No.: 295,511

[22] Filed: Aug. 24, 1994

[30] Foreign Application Priority Data

Aug. 24, 1993 [DE] Germany ..... 43 28 445.0

[51] Int. Cl.[6] ..... B65H 43/00

[52] U.S. Cl. ..... 271/176; 271/195; 271/204; 271/183

[58] Field of Search ..... 271/202, 204, 271/206, 176, 182, 183, 194, 195

[56] References Cited

U.S. PATENT DOCUMENTS

| | | | |
|---|---|---|---|
| 4,643,414 | 2/1987 | Weisgerber | 271/206 X |
| 5,251,891 | 10/1993 | Blaser et al. | 271/176 |
| 5,445,372 | 8/1995 | Blaser et al. | 271/204 X |

FOREIGN PATENT DOCUMENTS

| | | |
|---|---|---|
| 2077721 | 2/1993 | Canada . |
| 3432036 | 5/1985 | Germany . |
| 3413179 | 10/1985 | Germany . |
| 3736163 | 5/1988 | Germany . |
| 4130677 | 3/1993 | Germany . |
| 4201480 | 7/1993 | Germany . |
| 2156786 | 10/1985 | United Kingdom . |

OTHER PUBLICATIONS

Publication: Offsetpraxis, Aug. 7, 1986, pp. 22–33, "Drupa '86: Produktivitätssteigerung im Bogenoffsetdruck: die Summe vieler kleiner Schritte".

*Primary Examiner*—William E. Terrell
*Assistant Examiner*—Boris Milef
*Attorney, Agent, or Firm*—Herbert L. Lerner; Laurence A. Greenberg

[57] ABSTRACT

Device for conveying a sheet along a conveyance path to a sheet pile having a conveyor for gripping the sheet at least at one edge thereof, a drive connected to the conveyor, fixed guides for the sheet, a pneumatic device disposed in cooperative proximity with the guides, and a control or regulating device connected to adjustment elements of the conveyor, the drive and the pneumatic device, includes at least one sensor disposed in the conveyance path of the sheet for detecting movement of the sheet, the sensor being connected to the control or regulating device.

5 Claims, 5 Drawing Sheets

DEVICE FOR CONVEYING SHEETS TO A SHEET PILE

SPECIFICATION

The invention relates to a device for conveying sheets to a sheet pile, wherein the sheets are held by at least one edge thereof and, by means of guides and air-blowing or suction devices, are transported under control to the pile. The invention is particularly applicable in delivery systems of printing presses.

For the purpose of controlling or regulating the transporting and depositing operations to which printed sheets are subjected in a printing press, it has become known heretofore to provide blower nozzles, suction rollers or fans in the transport path of the sheets, and to have the operating personnel or pressman adjust the blowing or suction action manually. Sheet metal deflectors or guides, which cooperate with the air-blowing or suction devices, are further provided for guiding the sheets. These adjustments have as their objective the achievement of a smooth or placid and trouble-free sheet travel, so that the sheets do not come into contact with the sheet metal deflectors or guides and the sheets are neither damaged nor have had the image printed thereon smeared. Disadvantageous in this regard is that the quality of the manual adjustment depends upon the experience of the operator or pressman, and that the adjustments are not accommodated or adapted to the varying transport speeds.

In the control and regulating device disclosed in the published German Patent Document DE 34 13 179 A1, the speed of a sheet-processing machine is taken into account when adjustable elements in the delivery are adjusted. In this regard, an empirically determined family of characteristic curves based upon the speed of the machine is established for each controlled or regulated value or quantity. A disadvantageous of such a procedure is that the family of characteristics is determined empirically, i.e., it is not free from subjective influences. Furthermore, it is presupposed that the speed of the machine is proportional to the transport speed of the sheet in the delivery. This assumption is only approximate, components of motion deviating from the sheet travel direction being not taken into consideration. The control or regulation of adjustment operations in the delivery is additionally inflexible due to the rigidly prescribed families of characteristics.

It is accordingly an object of the invention to provide a device for conveying sheets to a sheet pile which permits a neat and proper contact-free guidance of sheets over the entire travel-speed range and, during the control or regulation, takes into account components of motion transverse to the sheet travel direction.

With the foregoing and other objects in view, there is provided, in accordance with the invention, a device for conveying a sheet along a conveyance path to a sheet pile including conveying means for gripping the sheet at least at one edge thereof, a drive connected to the conveying means, fixed guides for the sheet, a pneumatic device disposed in cooperative proximity with the guides, a control or regulating device connected to adjustment elements of the conveying means, the drive and the pneumatic device, comprising at least one sensor disposed in the conveyance path of the sheet for detecting movement of the sheet, the sensor being connected to the control or regulating device.

In accordance with another feature of the invention, the one sensor is disposed for effecting a coordinate-dependent and time-dependent detection of location, speed and acceleration of the respective sheet perpendicularly to a sheet travel direction along the conveyance path.

In accordance with a further feature of the invention, the conveying means includes at least one gripper device for holding the leading edge of the sheet, the one sensor being connected to the one gripper device, and an endless chain whereon the one gripper device is disposed.

In accordance with an added feature of the invention, the one sensor is a stationary spacing sensor for detecting amplitude of motion of the respective sheet transversely to sheet travel direction along the conveyance path, and including another stationary sensor actionable over the width of the respective sheet, the other sensor being directed in an acute angle onto the respective sheet surface for detecting local distribution of sheet deflection transversely to the sheet travel direction, at least a third stationary sensor oriented transversely to the sheet travel direction and in parallel with an edge of the respective sheet, the third sensor being effective for detecting local and temporal distribution of the sheet deflection in the sheet travel direction, and at least a fourth sensor displaceable with the conveying means for the respective sheet, the fourth sensor being being effective for detecting temporal distribution of the sheet deflection over the entire conveyance path.

In accordance with an additional feature of the invention, the sheet-conveying device includes a further stationary sensor for detecting the number and duration of contacts made between the respective sheet and the fixed guides.

In accordance with a concomitant feature of the invention, the at least one sensor is connected to a fuzzy-system for fuzzifying signals from the sensor.

The invention calls for providing at least one sensor in a conveying path of a sheet for determining or detecting movement of the sheet, the sensor being connected to a control and regulating device for a blast or suction device. While the sensor detects the the movement of the respective sheet, fluttering and contact of the sheet with sheet guidance means can be measured. The measurement signals of the sensor or sensors are processed in the control or regulating device, due to which the blast or suction action is varied, so that fluttering of the following sheet is reduced due to changed flow relationships. The sensor can detect coordinate and time-dependently for each sheet the site or location, the speed and the acceleration perpendicularly to the sheet travel direction. It is possible to install the sensors so that they are stationary or are displaceable on a gripper bar, the leading edge of the respective sheet being held by grippers.

In an alternative embodiment of the invention, there are provided a stationary sensor for determining the amplitude of movement of the respective sheet transverse to the sheet travel direction, a further stationary sensor for determining the local distribution of the sheet deflection transverse to the sheet travel direction, which is directed in an acute angle onto the sheet surface, yet a further stationary sensor, which determines the temporal and local distribution of the sheet deflection in the sheet travel direction, and a displaceable sensor which is coupled with the conveying means of the sheet and which determines the temporal distribution of the sheet deflection over the entire conveying path.

Particularly of advantage is the connection of the sensors to a fuzzy-system for fuzzifying the measurement signals, the control and regulating device being constructed as a fuzzy-control or regulator.

Other features which are considered as characteristic for the invention are set forth in the appended claims.

Although the invention is illustrated and described herein as embodied in a device for conveying sheets to a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
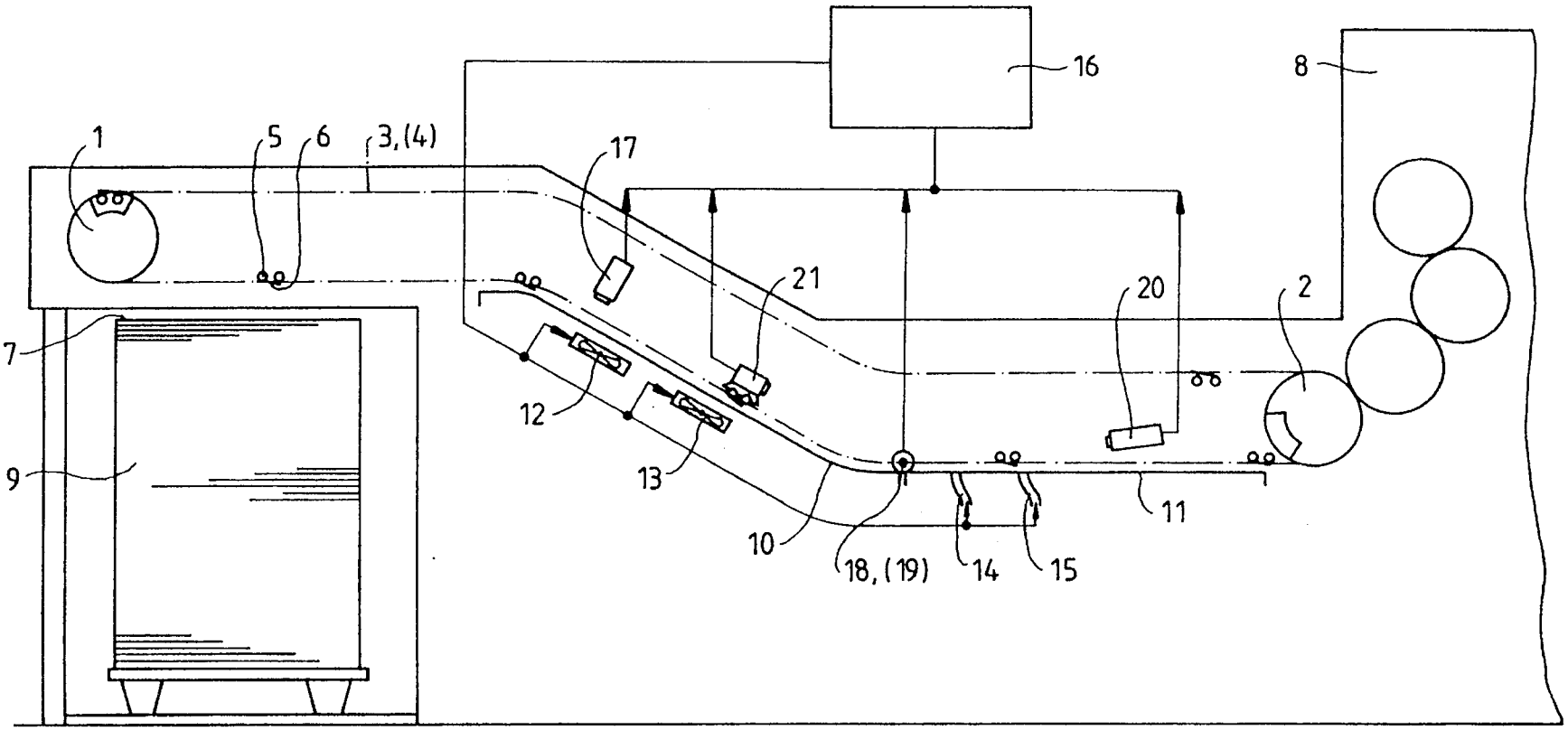
FIG. 1 is a fragmentary schematic and diagrammatic side elevational view of a printing-press delivery provided with the device according to the invention for conveying sheets to a sheet pile.

Referring now to the drawings and, first, particularly to FIG. 1 thereof, there is shown therein a printing-press delivery having two deflector rollers 1 and 2 about which respective chains 3 and 4 are looped, only the chain 3 of which is illustrated. Gripper bars 5 carrying grippers 6 for transporting sheets 7 from a last printing unit 8 of a printing press to a sheet pile 9 are fastened to the chains 3 and 4. Sheet guide plates or sheetmetal deflectors 10 and 11, fans 12 and 13 and blower or blast nozzles 14 and 15 are provided in a conveyor path below the chains 3 and 4. The fans 12 and 13 and the blower nozzles 14 and 15 are operatively connected with adjustment outputs of adjusting elements of a fuzzy control or regulator 16. An ultrasonic sensor 17 and optoelectronic sensors 18, 19, 20 and 21 are furthermore arranged in the conveyor path of the sheets, the sensor 19 being non-illustrated, and the sensor 21 being seated on a gripper bar 5.

Figure 2:
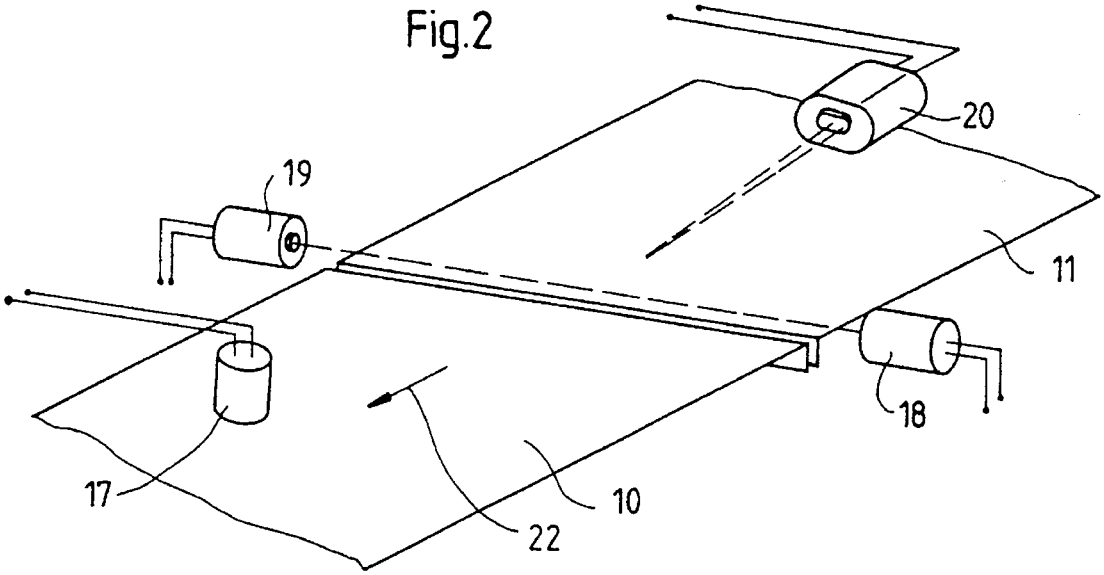
FIG. 2 is a diagrammatic perspective view of a possible arrangement of several of the sensors in the device according to the invention.

As shown in FIG. 2, the ultrasonic sensor 17 acts substantially in the middle of the sheet width perpendicularly to the sheet surface and perpendicularly to the sheet travel direction represented by the arrow 22. The sensors 18 and 19 are seated at the level of the impact edges of the sheet guide plates or sheetmetal deflectors 10 and 11, respectively, laterally to the sheets which are to be conveyed. The sensor 20 is disposed in an acute angle in a plane which lies parallel to the sheet travel direction 22.

Figure 3:
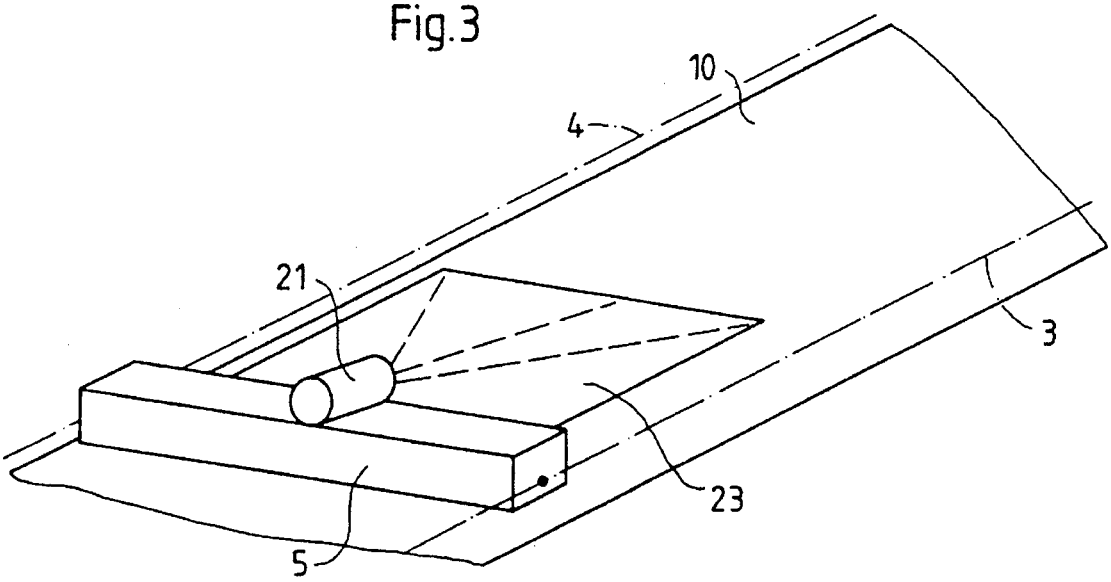
FIG. 3 is a view similar to that of FIG. 2 of a displaceable sensor in the device according to the invention.

As shown in FIG. 3, the sensor 21 disposed on a gripper bar 5 is displaceable together therewith. It determines in an acute angle the entire width of a sheet 23 to be transported.

Figure 4:
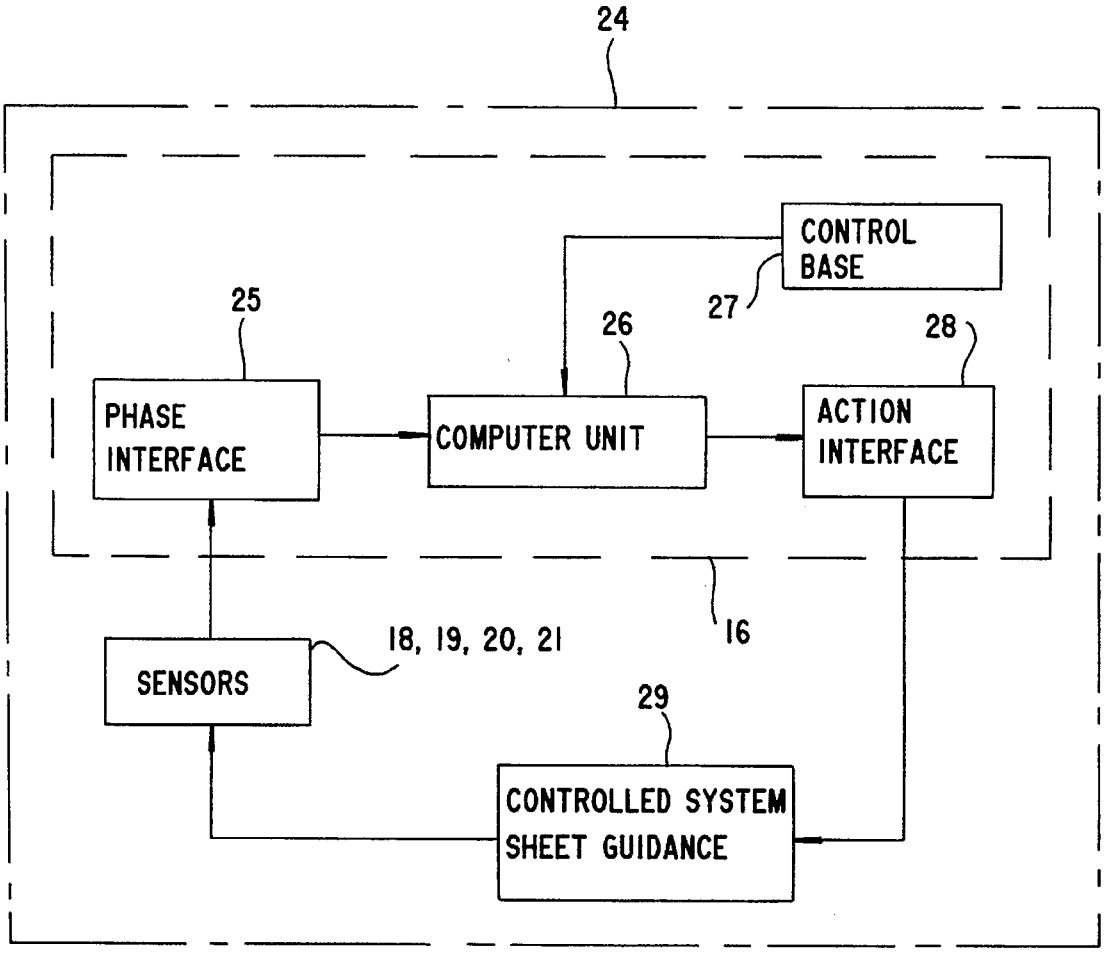
FIG. 4 is a block diagram of a fuzzy control or regulator according to the invention.
Figure 5A:
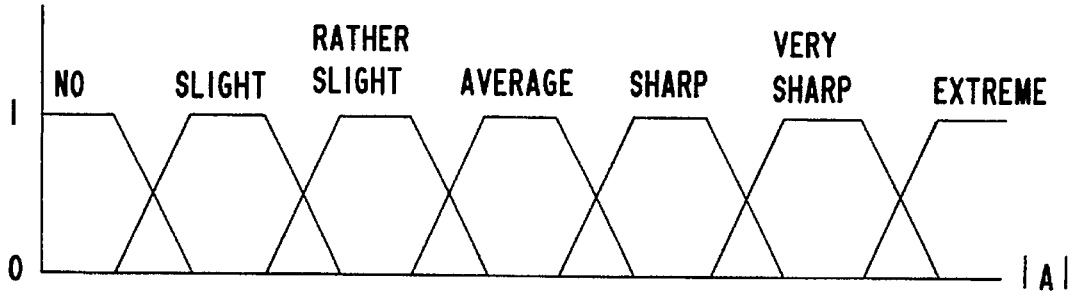
FIG. 5(*a*)–5(*e*) are graphs or plot diagrams of fuzzy variables and fuzzy quantities of the fuzzy control or regulator.
Figure 5B:
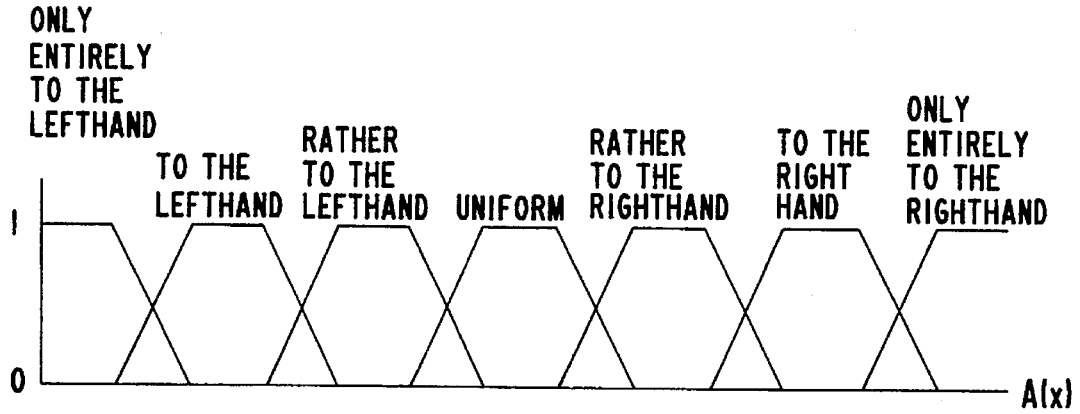
Figure 5C:
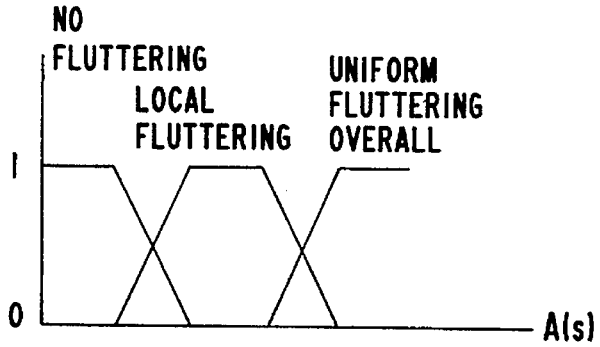
Figure 5D:
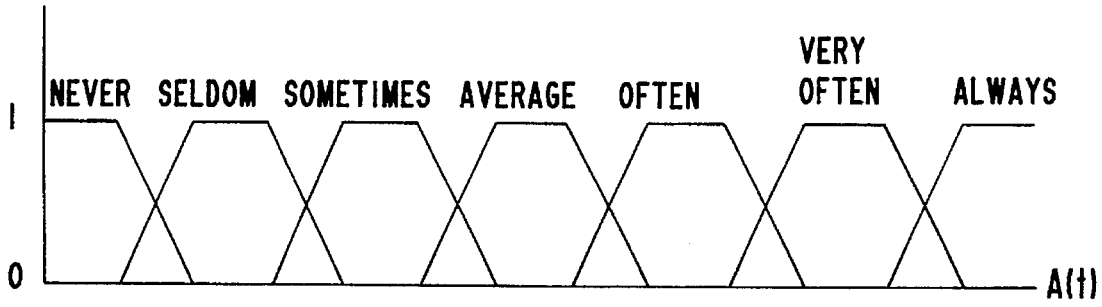
Figure 5E:
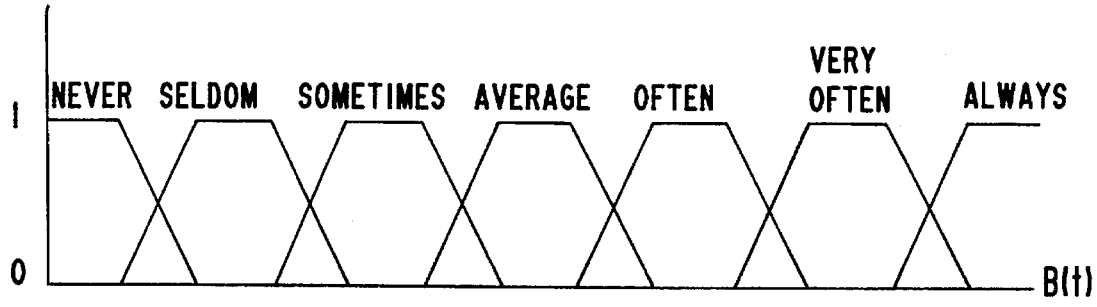

According to FIG. 4, the block diagram of the fuzzy control or regulator 16, which is a component of a printing-press control 24, contains a phase interface 25, a computer unit 26, a control base 27 and an action interface 28. The fuzzy control 16 is connected via the action interface 18 with a controlled system 29 for sheet guidance which includes adjusting elements, such as the fans 12 and 13 and the blower or blast nozzles 14 and 15.

The printing-press control 24 furnishes, by means of the computer unit 26, characteristic processing data, such as the sheet format, paper weight, printing speed, ink coating and adjustment values of a dryer system disposed in the conveying path, to the fuzzy control 16 which can determine values for pre-adjusting the adjustment elements of the controlled system 29. Fluttering of the sheet 23 is detected with the sensors 18, 19, 20 and 21 as a movement of the sheet 23 perpendicularly to the sheet travel direction 22. The measured values from the sensors 18, 19, 20 and 21 are processed in the phase interface 25 so that data regarding quantity, distribution and frequency of the fluttering movements are provided. In the computer unit 26, the intensity of the fluttering, the local and temporal distribution of the fluttering and the contact between the sheets 23 and the guide plates or sheetmetal deflectors 10 and 11 are defined as fuzzy-variables to which membership or affiliation functions are assigned in accordance with fuzzy-theory.

In the various plot diagrams 5(*a*) to 5(*e*), the abscissas are designated by |A|, A(x), A(s) and A(t) for the intensity and for the amplitude of the fluttering, respectively, and by B(t) for the contact between the sheets 23 and the sheet guide plates or sheetmetal deflectors 10 and 11. Appertaining membership functions are designated by # at the ordinates.

The fuzzy amounts or extents of the intensity of the fluttering, which are detected with amplitude measurements by means of the ultrasonic sensors 17, are shown in the plot diagram 5(*a*). The fuzzy-values or amounts shown in the diagram 5(*b*) for the local distribution of the flutterings transverse to the sheet travel direction 22 are detected by means of the photoelectric sensor 20, which can be replaced also by several ultrasonic sensors 17. The fuzzy-variable of the local distribution of the fluttering in the sheet travel direction 22 requires only the fuzzy-values or amounts shown in the plot diagram 5(*c*), which are detected by the sensor 21. The signals of the ultrasonic sensor 17 can be used simultaneously for detecting the fuzzy-values or amounts represented in the diagram 5(*d*) for the temporal distribution or the course of the fluttering. The fuzzy-values or amounts represented in diagram 5(*e*) for the contact between the sheets 23 and the guide plates or sheetmetal deflectors 10 and 11 are detected by means of the sensors 18 and 19 or also by the ultrasonic sensor 17, an amount of movement of the sheets 23 perpendicularly to the sheet travel direction 22 being evaluated as a contact when the amount of the amplitude of movement exceeds a prescribed limit value.

If uniform fluttering occurs throughout at the sheet 23, the fuzzy-control 16 effects a global adjustment of the entire air guidance. If only local fluttering is present at the sheets 23, the fuzzy-control 16 then evaluates the site or location or the sites or locations of the fluttering, in that the computer unit 26 queries the sensors 18, 19, 20 and 21, the signals of which have registered fluttering movements.

The signals from the sensor 21 revolving with the gripper bar 5 can be combined with signals for the position of the gripper bar 5, so that the temporal and local distribution of the fluttering can be processed for an intended setting of individual adjusting elements. The signals of the displaceable sensors 21 can be transmitted telemetrically to the fuzzy-control 16.

From the control base 27 implemented in the fuzzy-control 16, the computer unit 26 furnishes for each adjustment value, respectively, a fuzzy, blurred or poorly-defined value, which must be converted into a discrete adjustment vale. The defuzzification can be effected by the frequently employed focal point method. The rotary speed and the rotational direction of the fans 12 and 13 and the setting of throttle flaps or butterfly valves, or orifices or screens in the air guides of the blast or blower nozzles 14 and 15 can serve as adjustment values for the controlled systems 29. The fans 12 and 13 and the blast or blower nozzles 14 and 15 can be controlled individually for the width and over the length of the guide path, so that a local adjustment of the air guidance is possible.

I claim:

1. Device for conveying a sheet along a conveyance path to a sheet pile including conveying means for gripping the sheet at least at one edge thereof, a drive connected to the conveying means, fixed guides for the sheet, a pneumatic device disposed in cooperative proximity with the guides, a control or regulating device connected to adjustment elements of the conveying means, the drive and the pneumatic device, comprising at least one sensor disposed in the conveyance path of the sheet for detecting movement of the sheet, said sensor being connected to the control or regulating device, said one sensor being disposed for effecting a coordinate-dependent and time-dependent detection of location, speed and acceleration of the respective sheet perpendicularly to a sheet travel direction along the conveyance path.

2. Device for conveying a sheet along a conveyance path to a sheet pile including conveying means for gripping the sheet at least at one edge thereof, a drive connected to the conveying means, fixed guides for the sheet, a pneumatic device disposed in cooperative proximity with the guides, a control or regulating device connected to adjustment elements of the conveying means, the drive and the pneumatic device, comprising at least one sensor disposed in the conveyance path of the sheet for detecting movement of the sheet, said sensor being connected to the control or regulating device, said conveying means including at least one gripper device for holding the leading edge of the sheet, said one sensor being connected to said one gripper device, and an endless chain whereon said one gripper device is disposed.

3. Device for conveying a sheet along a conveyance path to a sheet pile including conveying means for gripping the sheet at least at one edge thereof, a drive connected to the conveying means, fixed guides for the sheet, a pneumatic device disposed in cooperative proximity with the guides, a control or regulating device connected to adjustment elements of the conveying means, the drive and the pneumatic device, comprising at least one sensor disposed in the conveyance path of the sheet for detecting movement of the sheet, said sensor being connected to the control or regulating device, said one sensor being a stationary spacing sensor for detecting amplitude of motion of the respective sheet transversely to sheet travel direction along the conveyance path, and a second stationary sensor effective over the width of the respective sheet, said second sensor being directed in an acute angle onto the respective sheet surface for detecting local distribution of sheet deflection transversely to the sheet travel direction, at least a third stationary sensor oriented transversely to the sheet travel direction and in parallel with an edge of the respective sheet, said third sensor being effective for detecting local and temporal distribution of the sheet deflection in the sheet travel direction, and at least a fourth sensor displaceable with said conveying means for the respective sheet, said fourth sensor being effective for detecting temporal distribution of the sheet deflection over the entire conveyance path.

4. Sheet-conveying device according to claim 3, including a further stationary sensor for detecting the number and duration of contacts made between the respective sheet and the fixed guides.

5. Device for conveying a sheet along a conveyance path to a sheet pile including conveying means for gripping the sheet at least at one edge thereof, a drive connected to the conveying means, fixed guides for the sheet, a pneumatic device disposed in cooperative proximity with the guides, a control or regulating device connected to adjustment elements of the conveying means, the drive and the pneumatic device, comprising at least one sensor disposed in the conveyance path of the sheet for detecting movement of the sheet, said sensor being connected to the control or regulating device, said at least one sensor being connected to a fuzzy-system for fuzzifying signals from said sensor.

* * * * *